US008213829B2

(12) United States Patent
Choi et al.

(10) Patent No.: US 8,213,829 B2
(45) Date of Patent: Jul. 3, 2012

(54) DEVELOPING DEVICE REMOVABLY MOUNTABLE IN AN IMAGE FORMING APPARATUS, AND IMAGE FORMING APPARATUS HAVING THE SAME

(75) Inventors: Jai Il Choi, Suwon-si (KR); Young Min Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/127,177

(22) Filed: May 27, 2008

(65) Prior Publication Data

US 2009/0074447 A1 Mar. 19, 2009

(30) Foreign Application Priority Data

Sep. 19, 2007 (KR) ..... 10-2007-0095069

(51) Int. Cl.
*G03G 21/16* (2006.01)

(52) U.S. Cl. ..... 399/111; 399/119; 399/110

(58) Field of Classification Search ..... 399/110, 399/111, 119
See application file for complete search history.

(56) References Cited

U.S. PATENT DOCUMENTS 4,666,290 A * 5/1987 Yoshiura ..... 399/12
5,937,240 A 8/1999 Kanno et al.
6,876,826 B2 * 4/2005 Noda et al. ..... 399/90
2003/0123896 A1 * 7/2003 Goto et al. ..... 399/90
2006/0257165 A1 * 11/2006 Kweon ..... 399/119
2007/0025761 A1 * 2/2007 Jeong et al. ..... 399/111

FOREIGN PATENT DOCUMENTS

CN 1410850 A 4/2003
CN 1904758 A 1/2007
JP 8-16069 1/1996
KR 2007-87738 8/2007

OTHER PUBLICATIONS

Office Action issued by Korean Patent Office in Korean Patent Application No. 2007-95069 on Oct. 1, 2008.
Chinese Office Action for corresponding Chinese Patent Application No. 200810125315.3 dated Jun. 24, 2010 (4 pgs).

* cited by examiner

*Primary Examiner* — David Gray
*Assistant Examiner* — Roy Y Yi
(74) *Attorney, Agent, or Firm* — Staas & Halsey LLP

(57) ABSTRACT

A developing device and an image forming apparatus having the same include a frame having a knob part, a photosensitive body provided in front of the knob part with respect to a first direction of mounting the developing device, and a rotation guide part provided in front of the photosensitive body with respect to the first direction, and to guide a rotational motion of the developing device. When the developing device is removed from the image forming apparatus, the knob part is rotated upward. A first protrusion is provided on a side surface of the frame to determine a mounting position of the developing device. When the knob part is rotated upward, the first protrusion is rotated in the same direction as the knob part. Accordingly, the developing device has an improved mounting/removing structure adequate to compactly manufacture the image forming apparatus, and improves handling convenience in mounting and removing the developing device.

21 Claims, 6 Drawing Sheets

DEVELOPING DEVICE REMOVABLY MOUNTABLE IN AN IMAGE FORMING APPARATUS, AND IMAGE FORMING APPARATUS HAVING THE SAME

CROSS-REFERENCE TO RELATED APPLICATION

This application claims the benefit of Korean Patent Application No. 2007-95069, filed Sep. 19, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a developing device removably mounted in a main body of the image forming apparatus, and an image forming apparatus having the developing device.

2. Description of the Related Art

An image forming apparatus, such as a printer, a copying machine, or a fax machine, forms an image on a printing medium according to an inputted image signal. Of the various types of image forming apparatuses, an electrophotographic image forming apparatus prints an image on the printing medium, such as paper, through feeding, developing, transferring, fusing, and discharging processes.

An image forming apparatus generally includes a cartridge type developing device in which a photosensitive body, a charging body and a developing body are integrally formed as a unit. The developing device is removably mounted in a main body of the image forming apparatus.

For the developing device to operate reliably and develop an image of high quality, the developing device should be stably mounted in a correct position in the main body. In addition, to provide a user with convenience in replacing the developing device or inspecting the interior of the image forming apparatus, the developing device should be mounted in the main body to be easily removable.

U.S. Pat. No. 5,937,240 discloses a developing device of an image forming apparatus, which can be mounted and removed to and from a main body only by pushing and pulling a knob of the developing device.

The disclosed developing device of U.S. Pat. No. 5,937,240 includes a first protrusion and a second protrusion which are formed on a side surface. The first protrusion determines a mounting position of the developing device. The second protrusion is positioned in a rear of the first protrusion with respect to a mounting direction of the developing device. The second protrusion maintains a posture of the developing device, and serves as a rotational center when the developing device is removed from the main body. The main body of the image forming apparatus is formed with a guide groove to guide the first protrusion and the second protrusion. The guide groove is formed with a positioning recess at a lower end thereof.

The disclosed developing device of U.S. Pat. No. 5,937,240 further includes a photosensitive body gear mounted to an end of a photosensitive body. When the developing device is mounted in the main body of the image forming apparatus, the photosensitive body gear is engaged with a driving gear mounted in the main body.

The operation of mounting and removing the developing device to and from the main body of the image forming apparatus will now be explained briefly. First, the first protrusion of the developing device is fitted into the guide groove of the main body, and the developing device is pushed in. The first protrusion and the second protrusion are guided by the guide groove. When the first protrusion is received in the positioning recess, the mounting of the developing device is completed. At this time, the photosensitive body gear is engaged with the driving gear.

When a user pulls the developing device from the main body, the developing device is rotated about the second protrusion. The first protrusion and the photosensitive body gear move upward, and are separated from the positioning recess and the driving gear, respectively. In such a state, when a user pulls even more on the developing device, the first protrusion and the second protrusion are guided by the guide groove, and the developing device is removed from the main body.

However, when the above described developing device of U.S. Pat. No. 5,937,240 rotates on the second protrusion, the moving range of the developing device is large. Thus, the above described developing device requires a large surrounding space for movement. Especially, a portion of the developing device which is spaced farthest from the second protrusion (i.e., a portion having the largest moving range) is positioned in a substantially center portion in the main body of the image forming apparatus. However, many other components are arranged densely in the center portion in the main body. Thus, a size of the image forming apparatus is increased to provide sufficient space for movement of the developing device in the center portion in the main body, which makes it difficult to compactly manufacture the image forming apparatus.

After the developing device is mounted in the main body of the image forming apparatus, when the driving gear is rotated by a driving source mounted in the main body, a rotational force is transmitted to the photosensitive body through the photosensitive body gear. In such a power transmission process, the developing device may vibrate. In order to restrain the vibration of the developing device, a press device may also be provided in the main body to press the developing device downward.

However, when the developing device disclosed in U.S. Pat. No. 5,937,240 is removed from the main body, the developing device is rotated largely in a direction opposite to the direction of a pressing force of the press device. In other words, while the pressing force of the press device acts downward, a portion of the developing device is rotated upward to be removed from the main body. Thus, when intending to remove the developing device from the main body of the image forming apparatus, a user should apply a force to the developing device that is larger than the pressing force of the press device. However, to aid the removal of the developing device from the main body, if the pressing force of the press device is set to be relatively lower in consideration of handling convenience, stably restraining the vibration of the developing device becomes more difficult. Conversely, if the pressing force of the press device is set to be relatively higher, handling convenience is deteriorated as removal of the developing device from the main body becomes more difficult.

The developing device is mounted with components (for example, terminals) on an upper surface thereof, which are contacted with components mounted in the main body when the developing device is installed in the main body. However, when the developing device is rotated upward in order to be removed from the main body, the components mounted on the upper surface of the developing device may be damaged by forced contact with the components mounted in the main body.

SUMMARY OF THE INVENTION

Therefore, it is an aspect of the invention to have a developing device and an image forming apparatus having the same, which has an improved mounting/removing structure adequate to compactly manufacture the image forming apparatus.

It is another aspect of the invention to have a developing device and an image forming apparatus having the same, which improves handling convenience in mounting and removing the developing device.

It is yet another aspect of the invention to have a developing device and an image forming apparatus having the same, which reduces possibility of damages to components mounted on an upper surface of the developing device when the developing device is removed from a main body of the image forming apparatus.

Additional aspects and/or advantages of the invention will be set forth in part in the description which follows and, in part, will be obvious from the description, or may be learned by practice of the invention.

In accordance with an aspect of the invention, there is a developing device removably mounted in an image forming apparatus, including: a frame having a knob part; a photosensitive body provided in front of the knob part with respect to a first direction for mounting the developing device; and a rotation guide part provided in front of the photosensitive body with respect to the first direction, and to guide a rotational motion of the developing device.

In accordance with an aspect of the invention, when the developing device is to be removed from the image forming apparatus, the knob part may be rotated upward.

In accordance with an aspect of the invention, the developing device may further include a first protrusion to protrude outward from a side surface of the frame to determine a mounting position of the developing device in the image forming apparatus. When the knob part is rotated upward, the first protrusion may be rotated in the same direction as the knob part.

In accordance with an aspect of the invention, the rotation guide part may be positioned in front of the first protrusion with respect to the first direction.

In accordance with an aspect of the invention, the photosensitive body may have a rotating shaft, and may be mounted adjacent to the rotation guide part. The first protrusion may be coaxial with the rotating shaft of the photosensitive body.

In accordance with an aspect of the invention, the rotation guide part may include a rotation guide surface provided on a lower surface of the frame. The rotation guide surface may have an arc shape.

In accordance with an aspect of the invention, the developing device may further include a second protrusion to protrude outward from the side surface of the frame to a rear of the first protrusion to guide movement of the developing device in the image forming apparatus.

In accordance with an aspect of the invention, the frame may include an upper surface with a terminal at a front portion of the developing device to supply power to a memory or a switch operating member to operate a micro switch mounted in the image forming apparatus, and in front of the rotation guide part.

In accordance with another aspect of the invention, there is a developing device removably mounted in an image forming apparatus, including: a knob part provided to rotate upward along with the developing device relative to the image forming apparatus; and a positioning protrusion provided at a front portion of the developing device in front of the knob part with respect to a direction for mounting the developing device into the image forming apparatus. When the knob part is rotated upward, the positioning protrusion may be rotated upward together with the knob part.

In accordance with yet another aspect of the invention, there is an image forming apparatus including: a main body; and a developing device removably mounted in the main body, the developing device including: a frame having a knob part; a first protrusion to protrude outward from a side surface of the frame, the first protrusion being positioned at a front portion of the developing device in front of the knob part with respect to a first direction for mounting the developing device into the main body; and a rotation guide part provided in the frame at the front portion of the developing device in front of the first protrusion with respect to the first direction, and to guide a rotational motion of the developing device.

In accordance with an aspect of the invention, the main body may include a positioning recess to receive the first protrusion. When the knob part is rotated upward relative to the image forming apparatus, the first protrusion may be rotated upward and may escape from the positioning recess.

In accordance with an aspect of the invention, the rotation guide part may include a rotation guide surface provided on a lower surface of the frame, and the main body may include a support part to support the rotation support surface.

In accordance with an aspect of the invention, when the knob part is rotated upward relative to the image forming apparatus, the rotation guide surface may perform a sliding motion while being supported by the support part.

In accordance with an aspect of the invention, the developing device may further include a photosensitive body having a rotating shaft and mounted adjacent to the rotation guide part, and the first protrusion may be coaxial with the rotating shaft of the photosensitive body.

In accordance with an aspect of the invention, the developing device may further include a photosensitive body gear mounted to an end portion of the photosensitive body, and the main body may include a driving gear to be engaged with the photosensitive body gear. When the knob part is rotated upward, the photosensitive body gear may be rotated upward and may be disengaged from the driving gear.

In accordance with an aspect of the invention, a developing device to be removably mounted in an image forming apparatus, includes: a frame comprising an outward shape of the developing device; a photosensitive body to form an electrostatic latent image and being contained within the frame in a front portion thereof; and a rotation guide part formed on a bottom portion of the frame to correspond to the photosensitive body and comprising a rotation guide surface formed to smoothly guide a rotational movement of the developing device relative to the image forming apparatus.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings, of which.

DETAILED DESCRIPTION OF THE EMBODIMENTS

Figure 1:
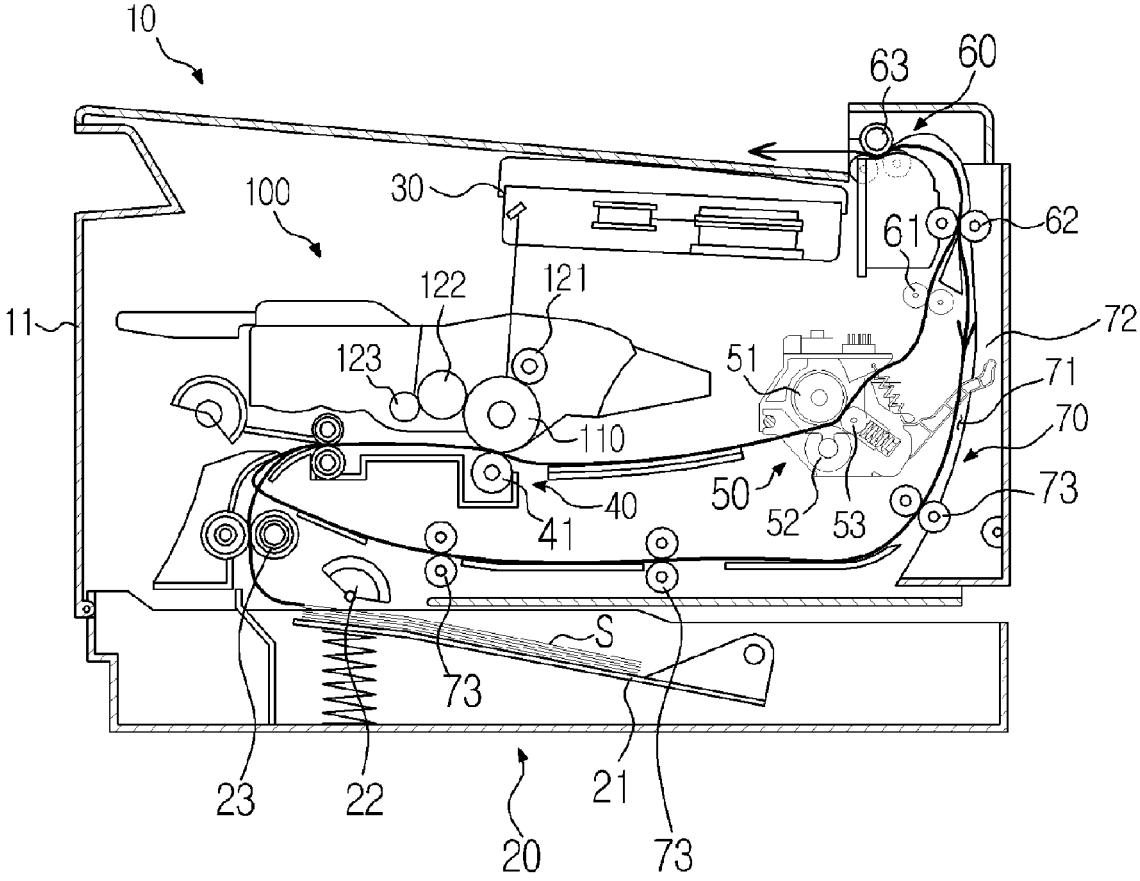
FIG. 1 is a sectional view illustrating various components of an image forming apparatus according to an aspect of the present invention.

Reference will now be made in detail to aspects of the present invention, examples of which are illustrated in the accompanying drawings, wherein like reference numerals refer to like elements throughout. The aspects are described below in order to explain the present invention by referring to the figures.

FIG. 1 is a sectional view illustrating various components of an image forming apparatus according to an aspect of the present invention. As shown in FIG. 1, an image forming apparatus includes a main body 10, which forms an external shape of the image forming apparatus and supports the various components accommodated therein. Inside the main body 10 are mounted a feeding device 20, a laser scanning device 30, a developing device 100, a transfer device 40, a fusing device 50, a discharge device 60, and a duplex printing device 70.

The main body 10 also includes a cover 11 that is hingedly coupled to the main body 10 to reveal or cover an opening of the main body 10. A user can open the cover 11 and obtain access to the interior of the main body 10 through the opening of the main body 10, to inspect the interior of the main body 10 or replace expendable components (i.e., consumables), such as the developing device 100.

The feeding device 20 feeds a printing medium, e.g., a paper S, towards the developing device 100. The feeding device 20 includes a feeding tray 21 to load the paper S thereon, a pickup roller 22 to pick up the paper S stored in the feeding tray 21 sheet by sheet, and a feeding roller 23 to feed the picked-up paper S towards the developing device 100.

The developing device 100 supplies toner to an electrostatic latent image formed on a photosensitive body 110 to develop the electrostatic latent image into a toner image. The developing device 100 is provided in a cartridge form, and is removably mounted in the main body 10. The operation of mounting and removing the developing device 100 and structures related thereto will be explained later.

The developing device 100 includes a photosensitive body 110, on a surface of which the electrostatic latent image is formed by the laser scanning device 30, a charging roller 121 to charge the photosensitive body 110, a developing roller 122 to supply toner to the electrostatic latent image formed on the photosensitive body 110, and a supply roller 123 to supply toner to the developing roller 122.

The transfer device 40 transfers the toner image formed on the photosensitive body 110 onto the paper S. The transfer device 40 includes a transfer roller 41 mounted in the main body 10 in an opposing arrangement to the photosensitive body 110. The transfer roller 41 presses the paper S toward the photosensitive body 110 so that the toner image formed on the surface of the photosensitive body 110 is transferred onto the paper S.

The fusing device 50 fuses the transferred toner image to the paper S. The fusing device 50 includes a heating roller 51 having a heat source therein, and a first press roller 52 and a second press roller 53 which are pressed to the heating roller 51 with a predetermined pressure. When the paper S passes between the heating roller 51 and the press rollers 52 and 53, the toner image is fused to the paper S by heat transferred from the heating roller 51 and pressure generated between the heating roller 51 and the press rollers 52 and 53.

The discharge device 60 includes a first discharge roller 61, a second discharge roller 62, and a third discharge roller 63 which are sequentially mounted so as to discharge the paper S, that had passed through the fusing device 50, to the outside of the main body 10.

The duplex printing device 70 feeds the paper S, on one surface of which an image has been printed, to an upstream side of the developing device 100, so that an image is printed also on another surface of the paper S. The duplex printing device 70 includes a duplex printing guide 72 which forms a duplex printing path 71, and duplex printing rollers 73 mounted in the duplex printing path 71 to feed the paper S. In a duplex printing operation, while the paper S, on one surface of which an image has been printed, is not discharged by the third discharge roller 63, but rather, the paper S is reversely fed to the duplex printing path 71 at a specific point of time. Thereafter, the paper S is fed again to the developing device 100 by the duplex printing rollers 71, and then passed through the developing device 100 and the fusing device 50. Accordingly, an image is printed on the another surface of the paper S.

Figure 2:
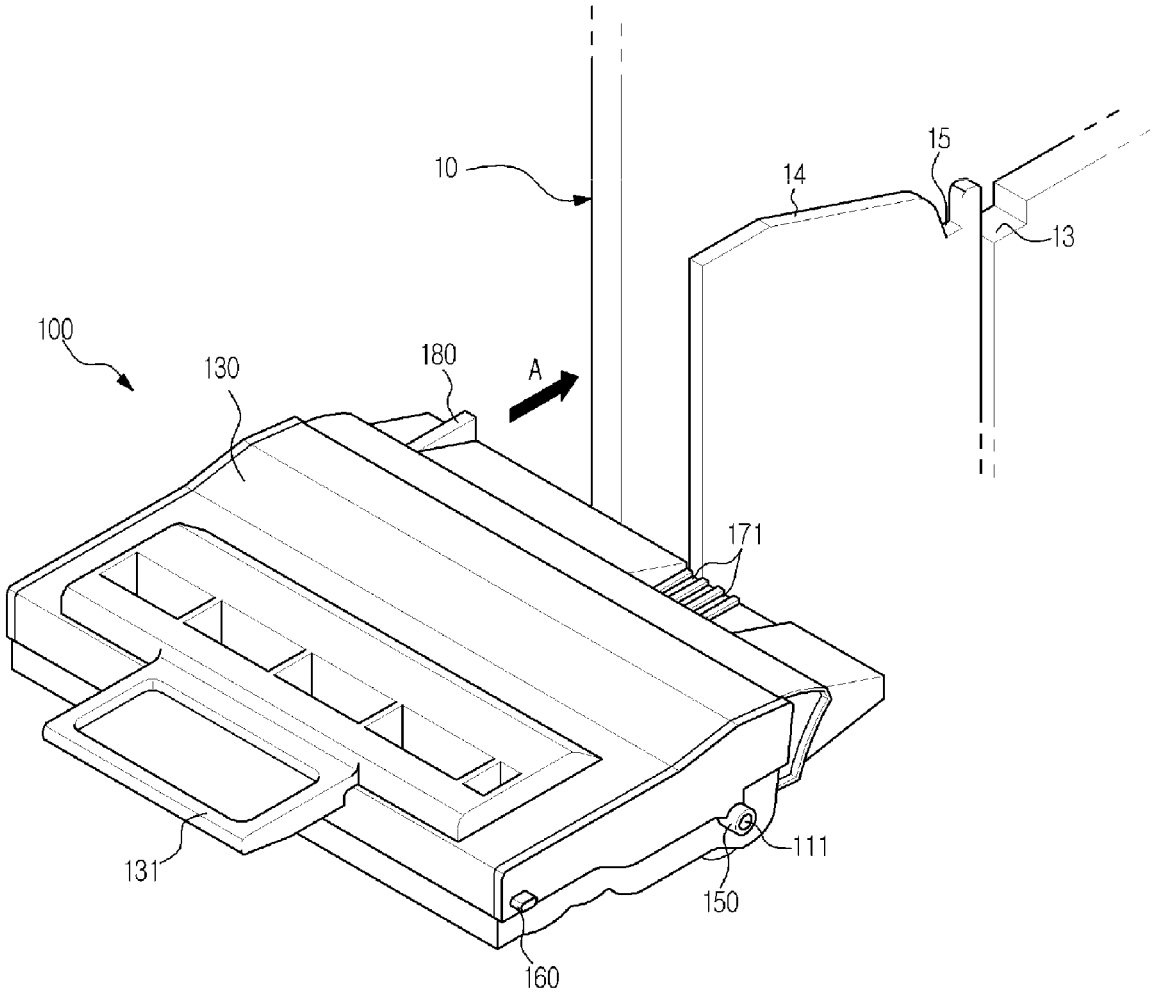
FIG. 2 is a perspective view illustrating a part of a main body and a developing device of the image forming apparatus according to an aspect of the present invention.
Figure 3:
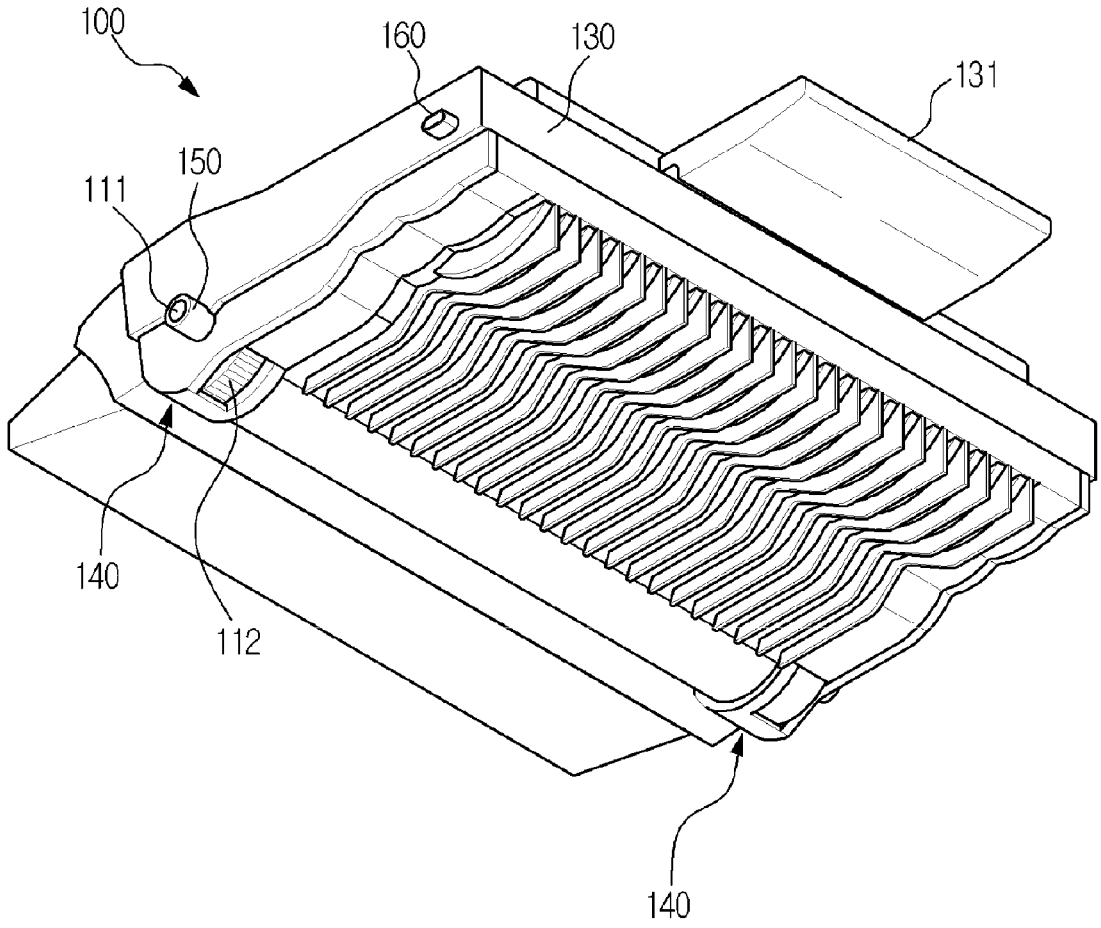
FIG. 3 is a bottom perspective view illustrating the developing device according to an aspect of the present invention.
Figure 4:
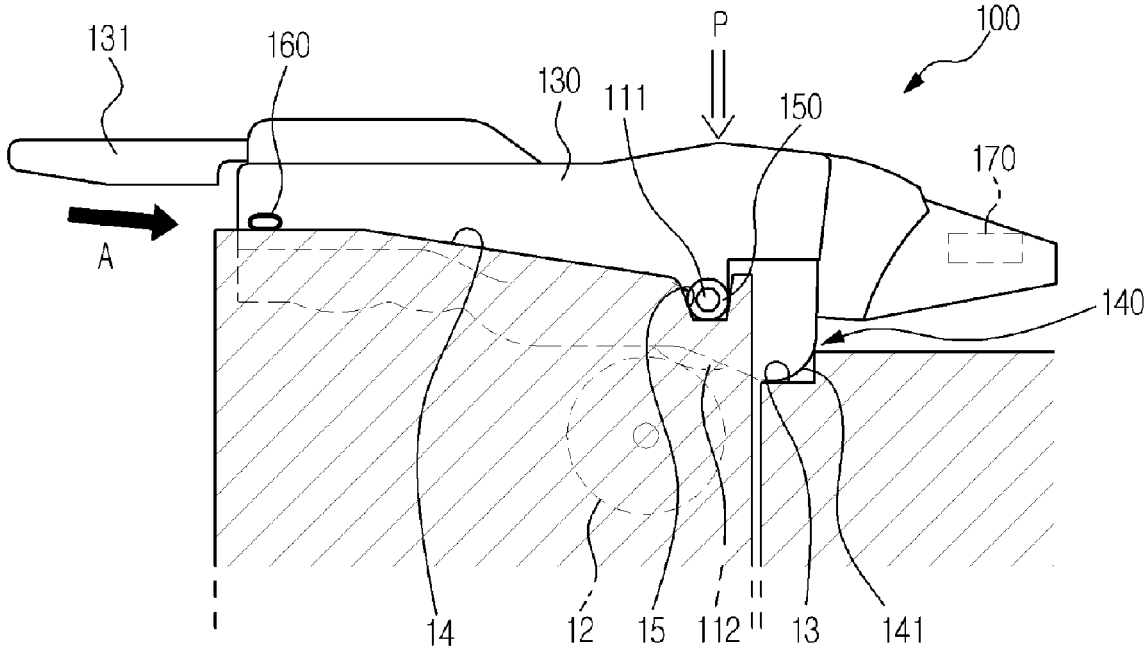
FIG. 4 is a side view illustrating a state in which the developing device according to an aspect of the present invention is mounted in the main body of the image forming apparatus.

FIG. 2 is a perspective view illustrating a part of the main body and the developing device of the image forming apparatus according to an aspect of the present invention, FIG. 3 is a bottom perspective view illustrating the developing device according to an aspect of the present invention, and FIG. 4 is a side view illustrating a state in which the developing device according to an aspect of the present invention is mounted in the main body of the image forming apparatus. As shown in FIGS. 2 to 4, the developing device 100 includes a frame 130 which forms an exterior shape thereof, and a knob part (or a handle) 131 provided at a rear portion of the frame 130 to enable a user to grasp the developing device 100.

Also, as shown in FIG. 1, the photosensitive body 110 is rotatably mounted in the frame 130. The photosensitive body 110 is positioned in the front of the developing device 100 and in a forward direction of the knob part 131 with respect to a direction of mounting the developing device 100 into the main body 10 ("A" direction in FIG. 2). The photosensitive body 110 has a rotating shaft 111, which is made of a conductive material. The rotating shaft 111 protrudes outward from both side (or lateral) surfaces of the frame 130 (shown in FIGS. 2 and 3), and is electrically connected to a power supply part (not shown) or a ground contact part (not shown) provided in the main body 10 while the developing device 100 is mounted in the main body 10.

A photosensitive body gear 112 is mounted to one end of the photosensitive body 110 (shown in FIG. 3), and a driving gear 12 is mounted in the main body 10 to correspond to the photosensitive body gear 112 (as shown in FIG. 4). When the developing device 100 is mounted into the main body 10, the photosensitive body gear 112 is engaged with the driving gear 12. When the driving gear 12 is rotated by a driving source (not shown) provided in the main body 10, a rotational force is transmitted to the photosensitive body 110 through the photosensitive body gear 112.

As shown in FIGS. 3 and 4, the frame 130 of the developing device 100 is provided with rotation guide parts 140 which are disposed in the front of the photosensitive body 110 with respect to the "A" direction. As shown in FIGS. 2 and 4, the main body 10 is provided with support parts 13 to correspondingly support the rotation guide parts 140 of the frame 130. Only the support part 13 provided in the left side of the main body 10 is illustrated in FIG. 2, and the illustration of the support part 13 provided in the right side of the main body 10 is omitted. In an aspect of the present invention, two rotation guide parts 140 are shown, each being located at the lateral sides of the developing device 100.

Describing in detail, the rotation guide parts 140 are positioned in front (or forward) of the rotating shaft 111 of the photosensitive body 110. Also, the rotation guide parts 140 are positioned below the rotating shaft 111 of the photosensitive body 110. When the developing device 100 is to be removed from the main body 10, the rotation guide parts 140 guide a rotational movement of the developing device 100 while the rotation guide parts 140 are being supported by the support parts 13. The rotation guide parts 140 may include rotation guide surfaces 141 provided at a lower surface of the frame 130. The rotation guide surfaces 141 are respectively provided at both side edge portions of the developing device 100 corresponding to the support parts 13 of the main body 10. It is preferred, though not required, that the rotation guide surfaces 141 are formed in an arc shape (or rounded) so as to smoothly guide the rotational movement of the developing device 100. In other words, the surface of the rotation guide surfaces 141 are shaped to aid the rotational movement of the developing device 100 while the rotation guide parts 140 are being supported by the support parts 13. In aspects of the present invention, the rotation guide parts 140 are a part of the frame 130 that corresponds to the photosensitive body 110 so that the rotation guide parts 140 are parts of the frame 130 that partially surround the photosensitive body 110. Accordingly, the rotation guide parts 140 have a curvature that corresponds to a curvature of the photosensitive body 110.

The frame 130 is provided with first protrusions 150 which protrude outward from both side surfaces of the frame 130. The first protrusions 150 have a role of guiding the movement of the developing device 100 when the developing device 100 is mounted or removed into/from the main body 10. In addition, the first protrusions 150 have a role of determining the mounting position of the developing device 100. The first protrusion 150 protruding outward from the right side surface of the frame 130 is illustrated in FIG. 2, and the first protrusion protruding outward from the left side surface of the frame 130 is illustrated in FIG. 3.

FIG. 2 also shows a portion of the main body that contains a raised surface with structures that mount the developing device 100. As shown in FIG. 2, the main body 10 is provided with guide rails 14 to slidingly guide the first protrusions 150 of the frame when the developing device 100 is being inserted into the main body 10. Only the guide rail 14 provided in the left side of the main body 10 is illustrated in FIG. 2. The main body 10 is further provided with positioning recesses 15 located in front (or forward) of the guide rails 14 with respect to the "A" direction. When the developing device 100 is mounted into the main body 10, the first protrusions 150 are received in the positioning recesses 15 after being guided by the guide rails 14. Thereby, the mounting position of the developing device 100 is determined by the positioning recesses 15.

As shown in FIG. 4, the first protrusions 150 are positioned adjacent to the rotation guide parts 140, but to the rear (or rearward) of the rotation guide parts 140. The first protrusions 150 are formed to surround the rotating shaft 111 of the photosensitive body 110, and may be formed coaxially with the rotating shaft 111. That is, in aspects of the present invention, the first protrusion 150 is a tube like protrusion that sheathes the rotating shaft 111, and has a circular cross section. In other aspects, the first protrusion 150 may have other cross sectional shape, such as hemispheric or rectangular shapes.

The frame 130 is further provided with second protrusions 160 protruding outward from both side surfaces of the frame 130 at the rear (or rearward) of the first protrusions 150. When the developing device 100 is mounted or removed into/from the main body 10, the second protrusions 160 guide the movement of the developing device 100 together with the first protrusions 150.

Although it is not illustrated in the drawings, a press device may be provided in the main body 10 to press the developing device 100 downward. The press device is disposed at a position corresponding to the photosensitive body 110 above the developing device 100, so as to restrain movement of the developing device 100 due to vibrations generated during the operation of the photosensitive body 110. The pressing force of the press device on the developing device 100 is shown by an arrow P in FIG. 4. As shown in FIG. 4, pressing force of the press device is applied to a location on the developing device 100 that is opposite to the rotation guide parts 140. Accordingly, the pressing force is almost evenly distributed to the first protrusions 150 and the positioning recesses 15, and to the rotation guide parts 140 and the support parts 13 for greater stability of the mounted developing device 100.

As shown in FIGS. 2 and 4, a memory 170 may be mounted in the developing device 100. Information including an identification (ID) of the developing device, residual quantity of toner, quantity of waste toner, and the like are stored in the memory 170. In order to supply power to the memory 170, a terminal 171 is provided in the front of the rotation guide parts 140 on an upper surface of the frame 130. When the developing device 100 is mounted into the main body 10, the terminal 171 is connected to a power terminal (not shown) provided in the main body 10.

A switch operating member 180 is provided in the front of the rotation guide parts 140 on the upper surface of the frame 130. When the developing device 100 is mounted or removed into/from the main body 10, the switch operating member 180 operates a micro switch (not shown) provided in the main body 10. When the developing device 100 is mounted into the main body 10, and the switch operating member 180 presses the micro switch, a control part of the image forming apparatus determines that the developing device 100 has been installed. On the other hand, when the developing device 100 is removed from the main body 10, and the switch operating member 180 is separated from the micro switch, the control part determines that the developing device 100 has been removed.

Figure 5:
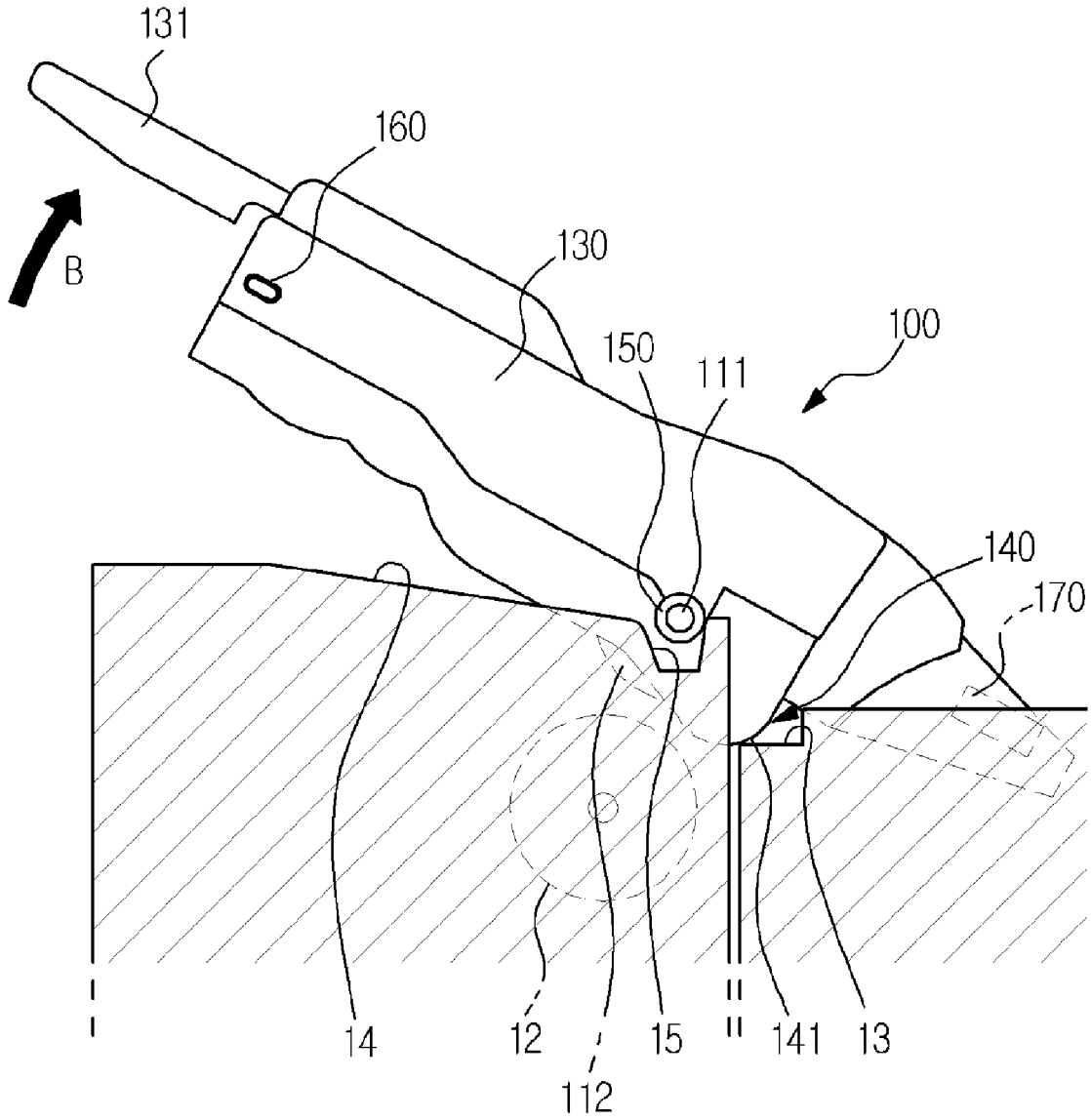
FIGS. 5 and 6 are views for explaining an operation of removing the developing device according to an aspect of the present invention from the image forming apparatus.
Figure 6:
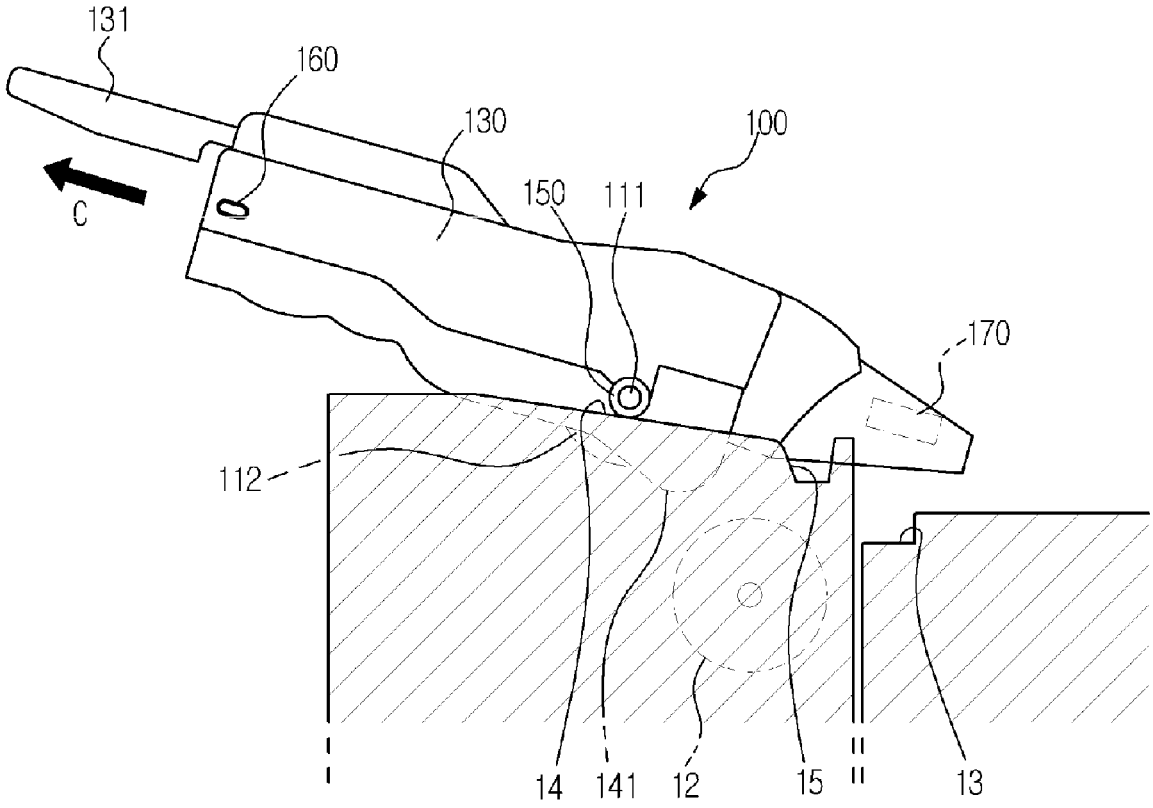

Hereinafter, the operation of mounting and removing the developing device 100 into and from the main body 10 of the image forming apparatus according to an aspect of the present invention will be explained with reference to FIGS. 2 and 4 to 6. FIGS. 5 and 6 are views for explaining the operation of removing the developing device from the image forming apparatus.

First, the operation of mounting the developing device 100 will be explained with reference to FIG. 2. A user grasps the knob part 131 of the developing device 100, and puts the first protrusions 150 of the developing device 100 on the guide rails 14 of the main body 10. Thereafter, the user pushes in the developing device 100 in the "A" direction, so that the first protrusions 150 are guided by the guide rails 14. When the developing device 100 is inserted to a specific extent, the second protrusions 160 are advanced onto the guide rails 14, and guide the movement of the developing device 100 together with the first protrusions 150. The developing device 100 is then further inserted further in the "A" direction until the first protrusions 150 are received in the positioning recesses 15. The mounting position of the developing device 100 is thereby determined, and the mounting operation is completed as shown in FIG. 4.

When the developing device 100 is completely installed, the photosensitive body gear 112 is engaged with the driving gear 12 of the main body 10. In such a state, if a printing command is inputted, a driving force is transmitted to the photosensitive body 110 to rotate the photosensitive body 110, and thus the image forming operation is carried out.

Next, the operation of removing the developing device 100 will be explained. The user grasps the knob part 131 of the developing device 100, and raises the developing device 100. The rotation guide parts 140, supported by the support parts 13 of the main body 10, serve as a pivot, and the knob part 131 is rotated in a "B" direction (or in an arc) as shown in FIG. 5. The rotation guide parts 140 perform a sliding motion while contacting the support parts 13 of the main body 10, and guide the rotational movement of the developing device 100 relative to the support parts 13.

When the developing device 100 is rotated, the first protrusions 150 and the photosensitive body gear 112 positioned in the rear of the rotation guide parts 140 are rotated upward and draw a small arc. Thereby, the first protrusions 150 escape from the positioning recesses 15 of the main body 10, and the photosensitive body gear 112 is disengaged from the driving gear 12 of the main body 10. Accordingly, the developing device 100 is turned into a state capable of being removed from the main body 10.

Thereafter, the user grasps the knob part 131, and pulls out the developing device 100 in a "C" direction. The "C" direction is generally opposite to the "A" direction. As shown in FIG. 6, the developing device 100 is guided by the first protrusions 150 and the guide rails 14 as the developing device 100 is removed from the main body 10.

As understood from FIG. 5, when the developing device 100 is rotated about the rotation guide parts 140, a portion of the developing device 100 which is positioned in the center portion of the main body 10 (a front portion of the developing device that includes the memory 170) pivots within a small range, which is advantageous in compactly manufacturing the image forming apparatus. In addition, a moving range of a portion (shown by arrow P in FIG. 5) of the developing device 100 which is pressed by the press device is not large. Accordingly, though the pressing force of the press device is set to be large, the user can remove the developing device 100 from the main body 10 with a small force. Also, since the terminal 171 and the switch operating member 180 positioned in the front of the rotation guide parts 140 are rotated downward when the developing device 100 is rotated, the terminal 171 and the switch operating member 180 are prevented from being damaged due to interference with other components which would otherwise occur because the terminal 171 and the switch operating member 180 also become disengaged from corresponding components in the main body 10. Also, it is apparent from FIGS. 4 and 5 that the first protrusions 150, the front portion of the developing device that includes the memory 170, and a location on the developing device 100 where the pressing force P of the press device is applied, are all located within a short distance of the rotation guide parts 140 to enable application of only a small force to remove the developing device 100, and a small resulting rotational movement of the developing device 100.

As is apparent from the above description, the developing device 100 according to aspects of the present invention is advantageous in compactly manufacturing the image forming apparatus, because the developing device 100 is constituted so as to be rotated within a small range in the center portion of the main body 10 of the image forming apparatus in which many other components are arranged densely.

Further, since the moving range of a portion of the developing device which is pressed by the press device is small, a user can easily remove the developing device from the main body by rotating the developing device with a small force.

Still further, damage to the components mounted on the upper surface of the developing device can be reduced when the developing device is removed from the main body.

Although a few aspects of the present invention have been shown and described, it would be appreciated by those skilled in the art that changes may be made in the aspects without departing from the principles and spirit of the invention, the scope of which is defined in the claims and their equivalents.

What is claimed is:

1. A developing device removably mountable in an image forming apparatus having a transfer roller, the developing device comprising:

a frame having a front end and a rear end;

a memory mounted on the frame;

a photosensitive body rotatably mounted to the frame; and a rotation guide part provided on a lower portion of the frame between the photosensitive body and the front end, the rotation guide part to guide a rotational motion of the developing device when the developing device is being separated from the image forming apparatus such that the rotation of the frame via the rotation guide part enables the photosensitive body to be disengaged from the transfer roller of the image forming apparatus, wherein a terminal electrically connected to the memory is positioned on the frame such that, when the rotation guide part guides a rotation of the frame before the developing device is separated from the image forming apparatus, the rotation of the frame via the rotation guide part allows the terminal to disengage from a terminal provided at the image forming apparatus together with the disengagement of the photosensitive body from the transfer roller of the image forming apparatus, and wherein the terminal is arranged on the frame such that the terminal disengages by moving in a downward direction with respect to the terminal of the image forming apparatus while the photosensitive body is arranged on the frame to disengage with the transfer roller by moving in an upward direction with respect to the transfer roller, during the rotation of the frame for removal of the developing device from the image forming apparatus.

2. The developing device according to claim 1, wherein the frame comprises a handle and when the developing device is to be removed from the image forming apparatus, the handle is rotated upward.

3. The developing device according to claim 2, further comprising:

a first protrusion to protrude outward from a side surface of the frame to determine a mounting position of the developing device in the image forming apparatus, wherein when the handle is rotated upward, the first protrusion is rotated in the same direction as the handle.

4. The developing device according to claim 3, wherein the rotation guide part is positioned in front of the first protrusion.

5. The developing device according to claim 4, wherein the photosensitive body has a rotating shaft, and is mounted adjacent to the rotation guide part, and the first protrusion is coaxial with the rotating shaft of the photosensitive body.

6. The developing device according to claim 5, wherein a rotation guide surface of the rotation guide part has an arc shape.

7. The developing device according to claim 3, further comprising:

a second protrusion to protrude outward from the side surface of the frame to a rear of the first protrusion to guide movement of the developing device in the image forming apparatus.

8. The developing device according to claim 1, further comprising:

a switch operation member arranged on an upper portion of the frame, to operate a switch mounted in the image forming apparatus, wherein the switch operating member is arranged in front of the rotation guide part.

9. A developing device removably mountable in an image forming apparatus having a transfer roller, the developing device comprising:

a frame having a front end and a rear end;

a memory mounted on the frame;

a photosensitive body rotatably mounted to the frame;

a positioning protrusion provided at the front end of the frame;

a terminal electrically connected to the memory, and arranged at the front end of the frame; and a rotation guide part provided on a lower portion of the frame between the positioning protrusion and the terminal, wherein the rotation guide part guides a rotation of the developing device when the developing device is being separated from the image forming apparatus such that the rotation of the developing device via the rotation guide part enables the photosensitive body to be disengaged from the transfer roller of the image forming apparatus, wherein when the rotation guide part guides a rotation of the developing device before the developing device is separated from the image forming apparatus, the rotation of the developing device via the rotation guide part allows the terminal to disengage from a terminal provided at the image forming apparatus together with the disengagement of the photosensitive body from the transfer roller of the image forming apparatus, and wherein the terminal is arranged on the frame such that the terminal disengages by moving in a downward direction with respect to the terminal of the image forming apparatus while the photosensitive body is arranged on the frame to disengage with the transfer roller by moving in an upward direction with respect to the transfer roller during the rotation of the frame for removal of the developing device from the image forming apparatus.

10. An image forming apparatus having a transfer roller, the image forming apparatus comprising:

a main body; and a developing device removably mountable in the main body, the developing device including, a frame having a front end and a rear end;

a memory mounted on the frame;

a photosensitive body rotatably mounted to the frame;

a first protrusion to protrude outward from a side surface of the frame, the first protrusion being positioned at the front end of the frame in front of the handle;

a terminal electrically connected to the memory, and arranged at the front end of the frame;

a rotation guide part provided on a lower portion the frame at the front end of the frame between the first protrusion and the terminal, wherein the rotation guide part guides a rotation of the developing device when the developing device is being separated from the main body such that the rotation of the developing device via the rotation guide part enables the photosensitive body to be disengaged from the transfer roller of the image forming apparatus, wherein when the rotation guide part guides a rotation of the frame before the developing device is separated from the image forming apparatus, the rotation of the frame via the rotation guide part allows the terminal to disengage from a terminal provided at the image forming apparatus together with the disengagement of the photosensitive body from the transfer roller of the image forming apparatus, and wherein the terminal is arranged on the frame such that the terminal disengages by moving in a downward direction with respect to the terminal of the image forming apparatus while the photosensitive body is arranged on the frame to disengage with the transfer roller by moving in an upward direction with respect to the transfer roller, during the rotation of the frame for removal of the developing device from the image forming apparatus.

11. The image forming apparatus according to claim 10, wherein the main body includes a positioning recess to receive the first protrusion, and wherein when the handle is rotated upward relative to the image forming apparatus, the first protrusion is also rotated upward and escapes from the positioning recess.

12. The image forming apparatus according to claim 10, wherein the rotation guide part comprises a rounded rotation guide surface provided on the lower portion of the frame, and the main body comprises a support part to support the rotation support surface.

13. The image forming apparatus according to claim 12, wherein when the handle is rotated upward relative to the image forming apparatus, the rotation guide surface performs a sliding motion while being supported by the support part.

14. The image forming apparatus according to claim 10, wherein the photosensitive body comprises a rotating shaft, and the first protrusion is coaxial with the rotating shaft of the photosensitive body.

15. The image forming apparatus according to claim 14, wherein the developing device further includes a photosensitive body gear mounted to an end portion of the photosensitive body, and the main body includes a driving gear to be engaged with the photosensitive body gear, and when the handle is rotated upward, the photosensitive body gear is rotated upward and is disengaged from the driving gear.

16. A developing device to be removably mountable in an image forming apparatus having a transfer roller, the developing device comprising:

a frame comprising an outward shape of the developing device and having a front end and a rear end;

a memory mounted on the frame;

a switch operating member arranged on an upper portion of the frame, to operate a micro switch mounted in the image forming apparatus;

a photosensitive body to form an electrostatic latent image and being rotatably mountable to the frame; and a rotation guide part formed on a bottom portion of the frame between the photosensitive body and the front end and comprising a rotation guide surface formed to guide a rotational movement of the developing device relative to the image forming apparatus when the developing device is being separated from the image forming apparatus such that the rotation of the developing device via the rotation guide part enables the photosensitive body to be disengaged from the transfer roller of the image forming apparatus, wherein a terminal electrically connected to the memory is positioned on the frame such that, when the rotation guide part guides a rotation of the frame before the developing device is separated from the image forming apparatus, the rotation of the frame via the rotation guide part allows the terminal to disengage from a terminal provided at the image forming apparatus together with the disengagement of the photosensitive body from the transfer roller of the image forming apparatus, and wherein the terminal is arranged on the frame such that the terminal disengages by moving in a downward direction with respect to the terminal of the image forming apparatus while the photosensitive body is arranged on the frame to disengage with the transfer roller by moving in an upward direction with respect to the transfer roller, during the rotation of the frame for removal of the developing device from the image forming apparatus, wherein the switch operating member is arranged in front of the rotation guide part with respect to a first direction for mounting the developing device into the image forming apparatus, and wherein the rotation guide part guides a rotation of the frame before the developing device is separated from the image forming apparatus, wherein the rotation of the frame via the rotation guide part allows the photosensitive body to move upwardly so as to disengage from a transfer roller of the image forming apparatus, and further allows the switch operating member to move downwardly so as to disengage from the micro switch provided at the image forming apparatus, before the developing device is moved in a second direction, opposite to the first direction, for removal of the developing device from the image forming apparatus.

17. The developing device according to claim 16, wherein a curvature of the rotation guide surface corresponds to a curvature of the photosensitive body.

18. The developing device according to claim 16, wherein the developing device rotates about the rotation guide part.

19. An image forming apparatus, comprising:

the developing device according to claim 16; and a main body, wherein the main body includes a raised surface on a lateral side thereof with a support part that supports the rotation guide part when the developing device is mounted in the image forming apparatus and during the rotational movement of the developing device relative to the image forming apparatus.

20. The developing device of claim 1, further comprising a handle provided adjacent to the rear end of the frame.

21. The developing device of claim 1, wherein the photosensitive body is provided in front of the handle with respect to a first direction for mounting the developing device.

* * * * *